US011394145B2

(12) United States Patent
Campbell et al.

(10) Patent No.: US 11,394,145 B2
(45) Date of Patent: Jul. 19, 2022

(54) ELECTRICAL CONNECTOR

(71) Applicant: Aptiv Technologies Limited, St. Michael (BB)

(72) Inventors: Jeffrey S. Campbell, West Bloomfield, MI (US); Wesley W. Weber, Jr., Metamora, MI (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/114,592

(22) Filed: Dec. 8, 2020

(65) Prior Publication Data

US 2021/0091497 A1 Mar. 25, 2021

Related U.S. Application Data

(62) Division of application No. 16/829,184, filed on Mar. 25, 2020, now Pat. No. 10,923,844, which is a division of application No. 16/354,599, filed on Mar. 15, 2019, now Pat. No. 10,637,171.

(51) Int. Cl.

| | |
|---|---|
| ***H01R 12/89*** | (2011.01) |
| ***H01R 12/79*** | (2011.01) |
| ***H01R 12/78*** | (2011.01) |

(52) U.S. Cl.

CPC ..... *H01R 12/89* (2013.01); *H01R 12/78* (2013.01); *H01R 12/79* (2013.01)

(58) Field of Classification Search

None

See application file for complete search history.

(56) References Cited

U.S. PATENT DOCUMENTS

| | | | | |
|---|---|---|---|---|
| 3,082,398 A | | 3/1963 | Valach | |
| 3,319,216 A | | 5/1967 | McCullough | |
| 4,634,195 A | | 1/1987 | Shoemaker | |
| 4,802,866 A | * | 2/1989 | Balzano ..... | H01R 12/78 439/496 |
| 4,824,391 A | | 4/1989 | Ii | |
| 5,102,346 A | | 4/1992 | Soes | |
| 5,173,058 A | | 12/1992 | Broeksteeg et al. | |

(Continued)

FOREIGN PATENT DOCUMENTS

| | | |
|---|---|---|
| CN | 201204285 Y | 3/2009 |
| CN | 102074839 A | 5/2011 |
| CN | 203415745 U | 1/2014 |

OTHER PUBLICATIONS

Chinese Office Action based off CN Application No. 20201081168.2, dated Apr. 28, 2021, 16 pages.

*Primary Examiner* — Ross N Gushi

(74) *Attorney, Agent, or Firm* — Billion & Armitage

(57) ABSTRACT

An electrical connector assembly includes a housing that is configured to receive a planar first substrate, The first substrate includes an electrically conductive first contact region. The electrical connector assembly is further configured to receive a planar second substrate that includes an electrically conductive second contact region defining a ridge protruding from a surface of the second substrate. The housing is configured to align the first contact region with the second contact region. The electrical connector assembly also includes a force application device applying a compressive contact force to the first and second substrates, thereby putting the first contact region in intimate compressive contact with the second contact region.

20 Claims, 10 Drawing Sheets

(56) References Cited

U.S. PATENT DOCUMENTS

| | | | | |
|---|---|---|---|---|
| 5,691,041 | A | 11/1997 | Frankeny et al. | |
| 5,697,794 | A * | 12/1997 | Mosquera ..... | H01R 12/79 439/496 |
| 6,261,116 | B1 | 7/2001 | Ceru | |
| 6,299,476 | B1 | 10/2001 | Schramme et al. | |
| 6,478,597 | B1 | 11/2002 | Roberts et al. | |
| 6,932,642 | B2 | 8/2005 | Beer et al. | |
| 7,144,256 | B2 | 12/2006 | Pabst et al. | |
| 2008/0045076 | A1 | 2/2008 | Dittmann et al. | |

* cited by examiner

ELECTRICAL CONNECTOR

CROSS-REFERENCE TO RELATED APPLICATION

This application is a divisional application and claims the benefit of U.S. patent application Ser. No. 16/829,184 filed Mar. 25, 2020 which is a divisional application that claimed the benefit of co-pending U.S. patent application Ser. No. 16/354,599 filed Mar. 15, 2019, the entire disclosure of each of which is hereby incorporated herein by reference.

TECHNICAL FIELD

The invention generally relates to an electrical connector, particularly to an electrical connector configured to electrically interconnect a flat cable.

BRIEF SUMMARY

According to one or more aspects of the present disclosure, an electrical connector assembly includes a housing including a planar first substrate having an electrically conductive first contact region and configured to receive a planar second substrate having an electrically conductive second contact region which defines a ridge protruding from a surface of the second substrate. The housing is configured to align the first contact region with the second contact region. The electrical connector assembly further includes a force application device configured to apply a compressive contact force to the first and second substrates, thereby putting the first contact region in intimate compressive contact with the second contact region.

In one or more embodiments of the electrical connector assembly according to the previous paragraph, the ridge is formed on an outer edge of a plated through hole in the second trace within the second contact region wherein a height of the ridge decreases from the outer edge to the plated through hole.

In one or more embodiments of the electrical connector assembly according to any one of the previous paragraphs, the ridge forms an inverted frustoconical shape.

In one or more embodiments of the electrical connector assembly according to any one of the previous paragraphs, the second contact region defines a plurality of the plated through holes arranged linearly in the second contact region.

In one or more embodiments of the electrical connector assembly according to any one of the previous paragraphs, the ridge is formed by a serpentine pattern in the second trace within the second contact region.

In one or more embodiments of the electrical connector assembly according to any one of the previous paragraphs, the compressive contact force comprises a first compressive contact force and a second compressive contact force in opposition to the first compressive contact force.

In one or more embodiments of the electrical connector assembly according to any one of the previous paragraphs, the force application device has a first spring member configured to apply the first compressive contact force to the first substrate and a second spring member configured to apply the second compressive contact force to the second substrate.

In one or more embodiments of the electrical connector assembly according to any one of the previous paragraphs, the first spring member is an arcuate first fixed beam having a first radius of curvature and the second spring member is an arcuate second fixed beam having a second radius of curvature and wherein the first radius of curvature is less than the second radius of curvature.

In one or more embodiments of the electrical connector assembly according to any one of the previous paragraphs, the first spring member and the second spring member are integrally formed within the force application device.

In one or more embodiments of the electrical connector assembly according to any one of the previous paragraphs, the electrical connector assembly also includes an actuating member that is moveable from a pre-staged position in which the actuating member is not located intermediate the first spring member and the second spring member to a staged position in which the actuating member is located intermediate the first spring member and the second spring member.

In one or more embodiments of the electrical connector assembly according to any one of the previous paragraphs, the actuating member is integral with a connector position assurance device that is configured to allow movement of the actuating member from the pre-staged position to the staged position when the housing is received within and fully mated with a corresponding mating connector.

In one or more embodiments of the electrical connector assembly according to any one of the previous paragraphs, the actuating member is sized, shaped, and arranged such that an increase in the compressive contact force is within a predetermined range regardless of an overall thickness of the first substrate and the second substrate.

In one or more embodiments of the electrical connector assembly according to any one of the previous paragraphs, the force application device has an open box-like structure that is configured to surround the first substrate and the second substrate.

In one or more embodiments of the electrical connector assembly according to any one of the previous paragraphs, the force application device is formed of a metallic material and the housing is formed of a polymeric material.

In one or more embodiments of the electrical connector assembly according to any one of the previous paragraphs, the first contact region is defined by an electrically conductive first trace on the first substrate and the second contact region is defined by an electrically conductive second trace on the second substrate and wherein the second substrate is a printed circuit board.

In one or more embodiments of the electrical connector assembly according to any one of the previous paragraphs, the second contact region defines a plurality of ridges protruding from a surface of the second substrate.

According to one or more aspects of the present disclosure, an electrical connector assembly includes a housing including a planar first substrate having a first contact region is disposed and a shroud configured to receive the housing within. The shroud includes a planar second substrate having a second contact region defining a ridge protruding from a surface of the second substrate. The housing and the shroud are configured to align the first contact region with the second contact region. The electrical connector assembly also includes a force application device applying a compressive contact force to the first and second substrates, thereby putting the first contact region in intimate compressive contact with the second contact region.

In one or more embodiments of the electrical connector assembly according to the previous paragraph, the force application device is disposed within the housing. The force application device includes a first spring member configured to apply the first compressive contact force to the first substrate and a second spring member configured to apply the second compressive contact force to the second substrate.

In one or more embodiments of the electrical connector assembly according to any one of the previous paragraphs, the housing further includes an actuating member that is moveable from a pre-staged position in which the actuating member is not located intermediate the first spring member and the second spring member to a staged position in which the actuating member is located intermediate the first spring member and the second spring member.

In one or more embodiments of the electrical connector assembly according to any one of the previous paragraphs, the actuating member is integral with a connector position assurance device that is configured to allow movement of the actuating member from the pre-staged position to the staged position when the housing is received within and fully mated with a corresponding mating connector.

BRIEF DESCRIPTION OF THE DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
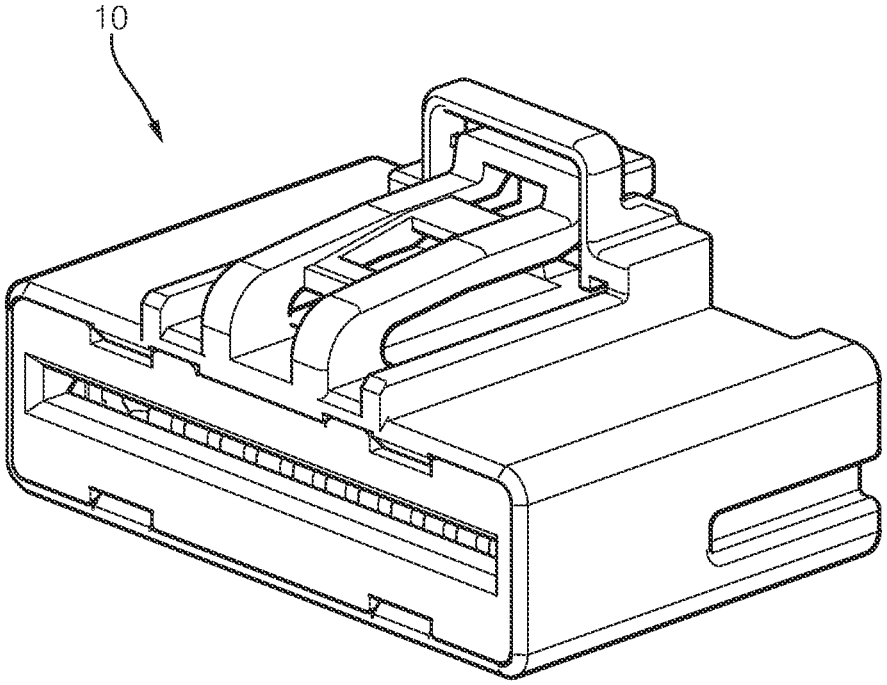
FIG. 1 is a perspective view of an electrical connector according to one embodiment of the invention.
Figure 2:
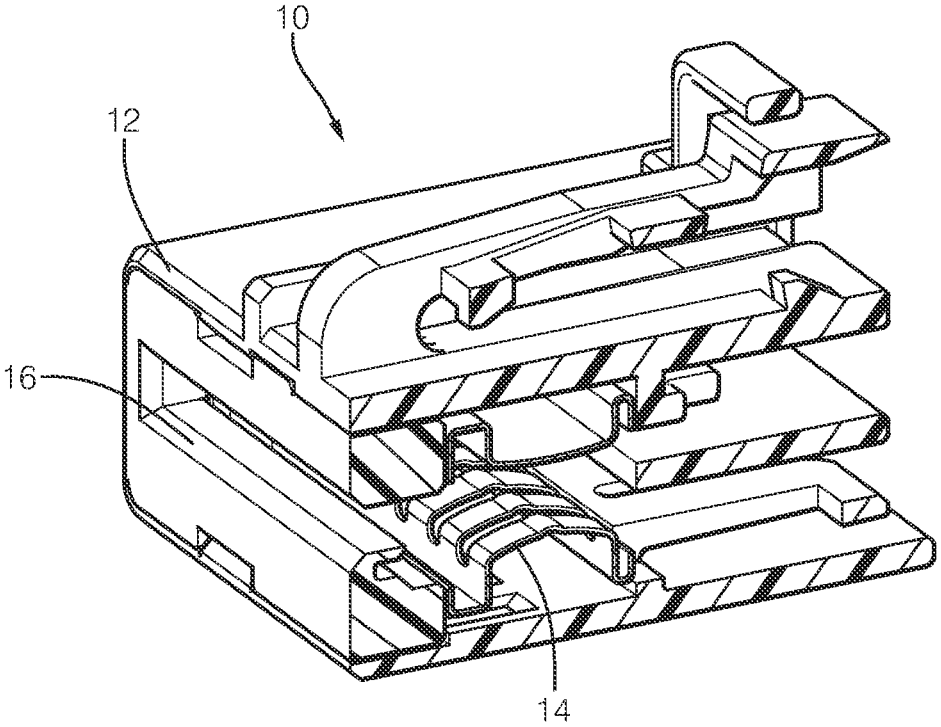
FIG. 2 is a perspective cross section view of the electrical connector of FIG. 1 according to one embodiment of the invention.
Figure 3:
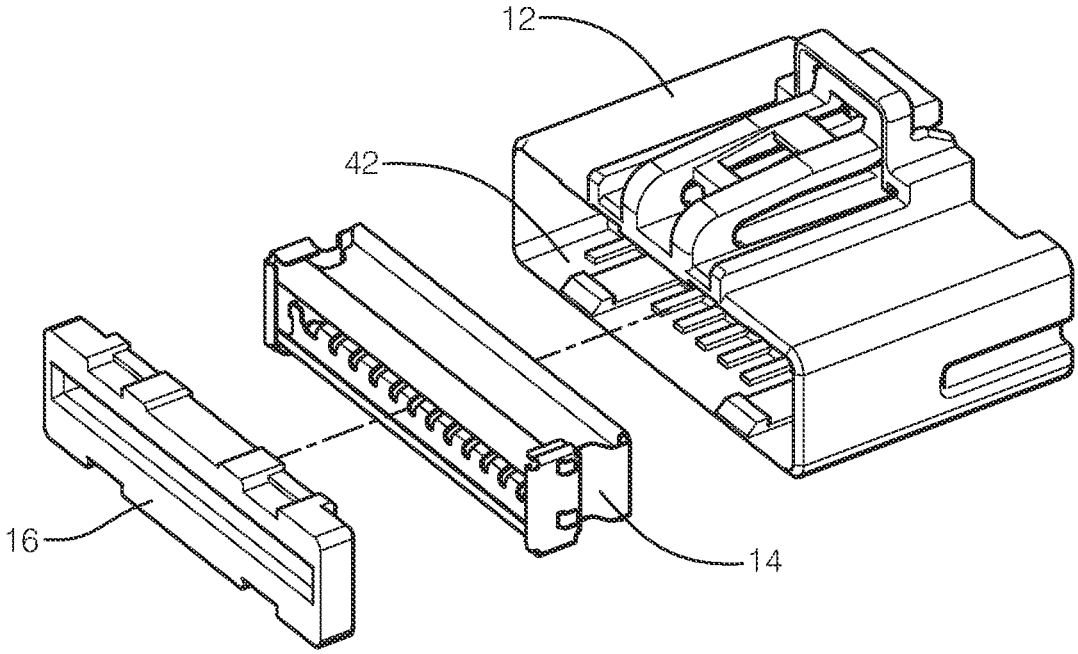
FIG. 3 is a perspective exploded view of the electrical connector of FIG. 1 according to one embodiment of the invention.
Figure 4:
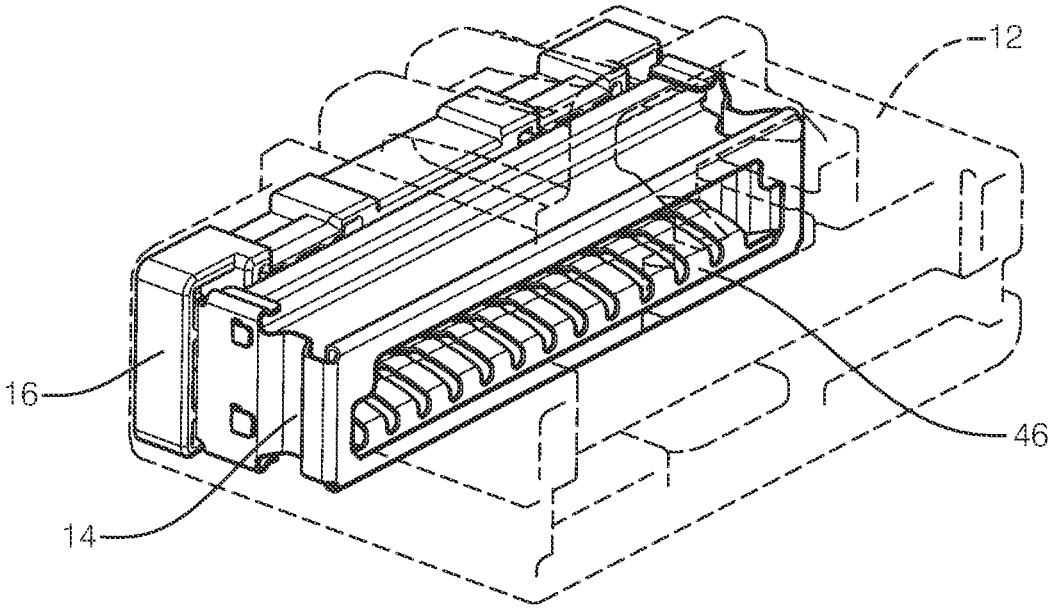
FIG. 4 is a perspective cut away view of the electrical connector of FIG. 1 according to one embodiment of the invention.

FIGS. 1-19 illustrate a non-limiting example of an electrical connector according to one or more embodiments of the invention. As best illustrated in FIG. 3, the electrical connector, hereinafter referred to as the connector 10, includes a housing 12, a force application device, hereinafter referred to as the spring array 14, and a retainer 16 that is configured to secure the spring array 14 within the housing 12.

Figure 8:
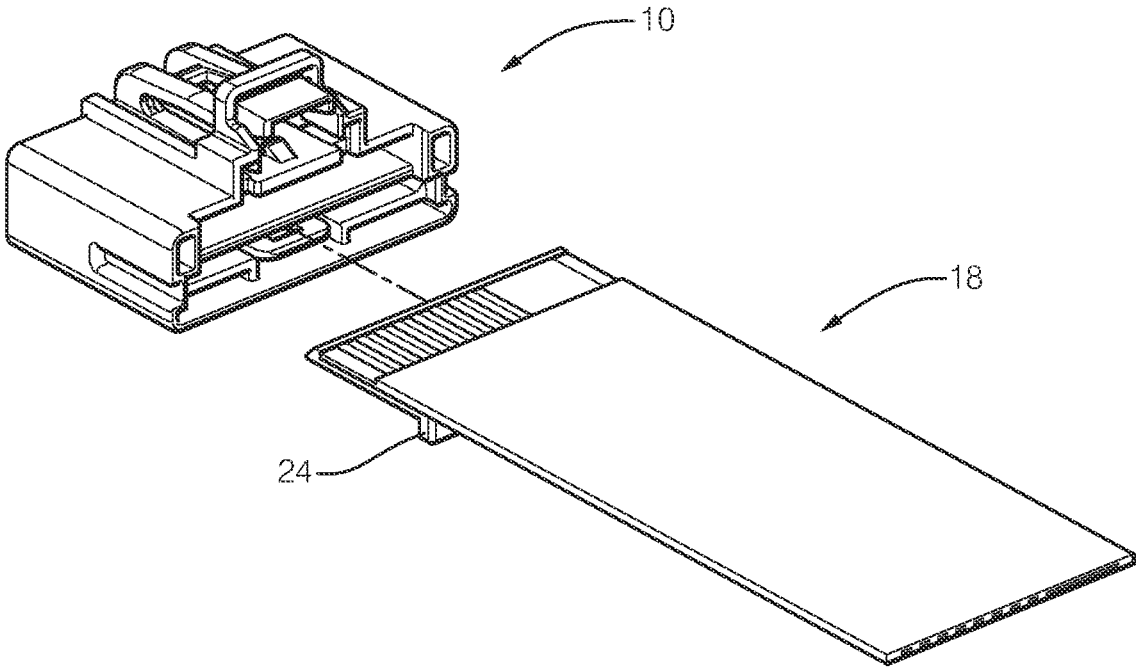
FIG. 8 is a perspective exploded view of the flat cable of FIG. 5 prior to insertion in the electrical connector of FIG. 1 according to one embodiment of the invention.
Figure 9:
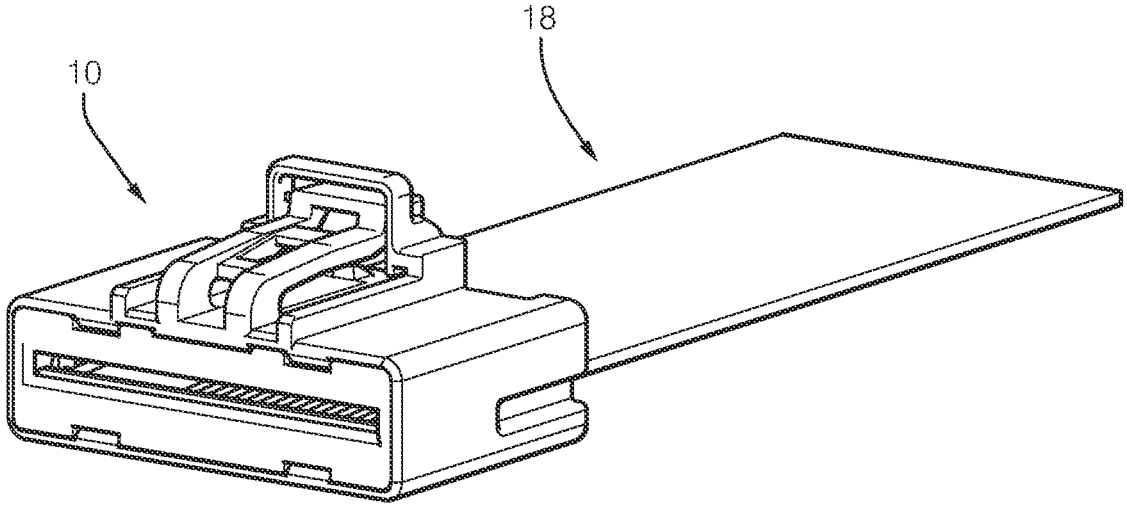
FIG. 9 is a perspective view of an assembly of the flat cable of FIG. 5 with the electrical connector of FIG. 1 according to one embodiment of the invention.
Figure 10:
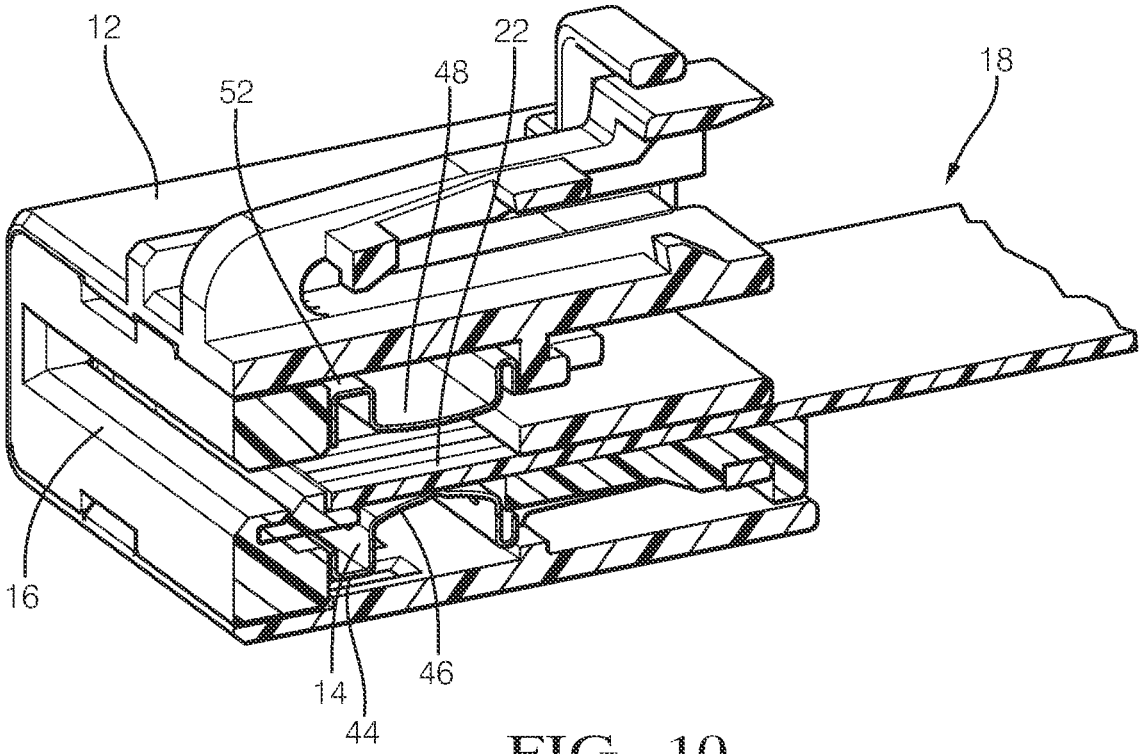
FIG. 10 is a perspective cross section view of the assembly of FIG. 9 according to one embodiment of the invention.

The connector 10 is configured to receive a planar first substrate, in this particular non-limiting example a flat cable 18, as best shown in FIGS. 8 and 9. The flat cable 18 includes a plurality of electrically conductive circuit traces (not shown), each having an exposed first contact region 22. The flat cable 18 also includes a stiffening member 24 that is attached to the flat cable 18 opposite the first contact regions 22.

Figure 15:
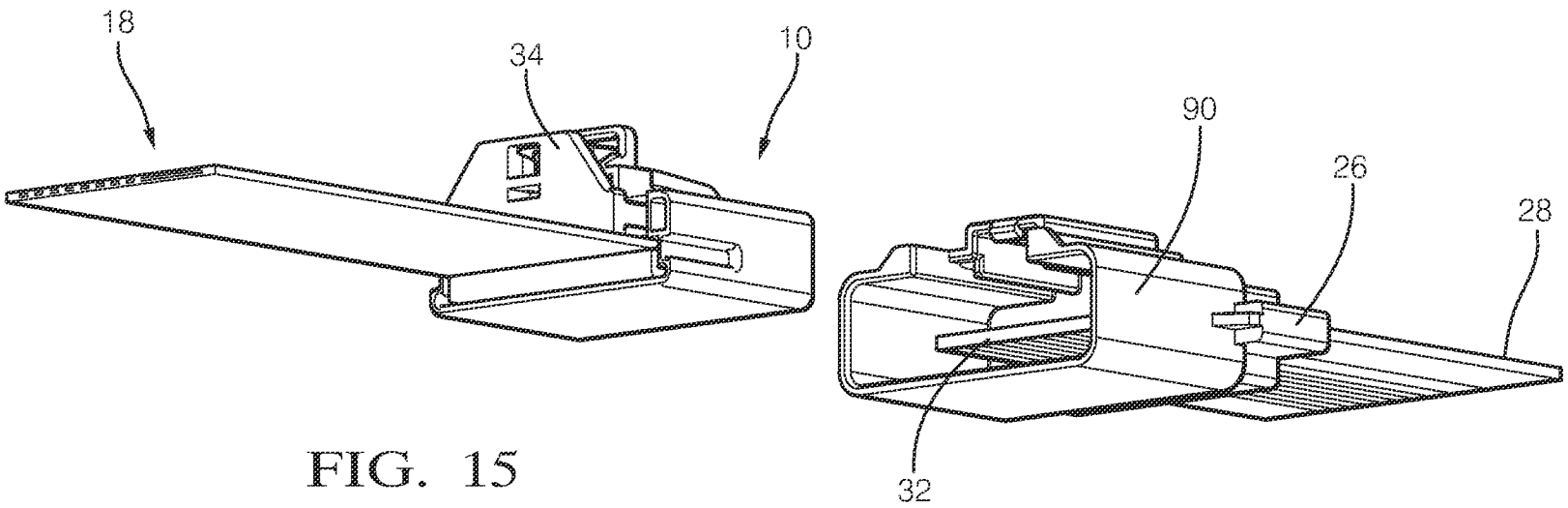
FIG. 15 is a perspective view of the assembly of FIG. 13 and a printed circuit board including a corresponding mating electrical connector according to one embodiment of the invention.
Figure 16:
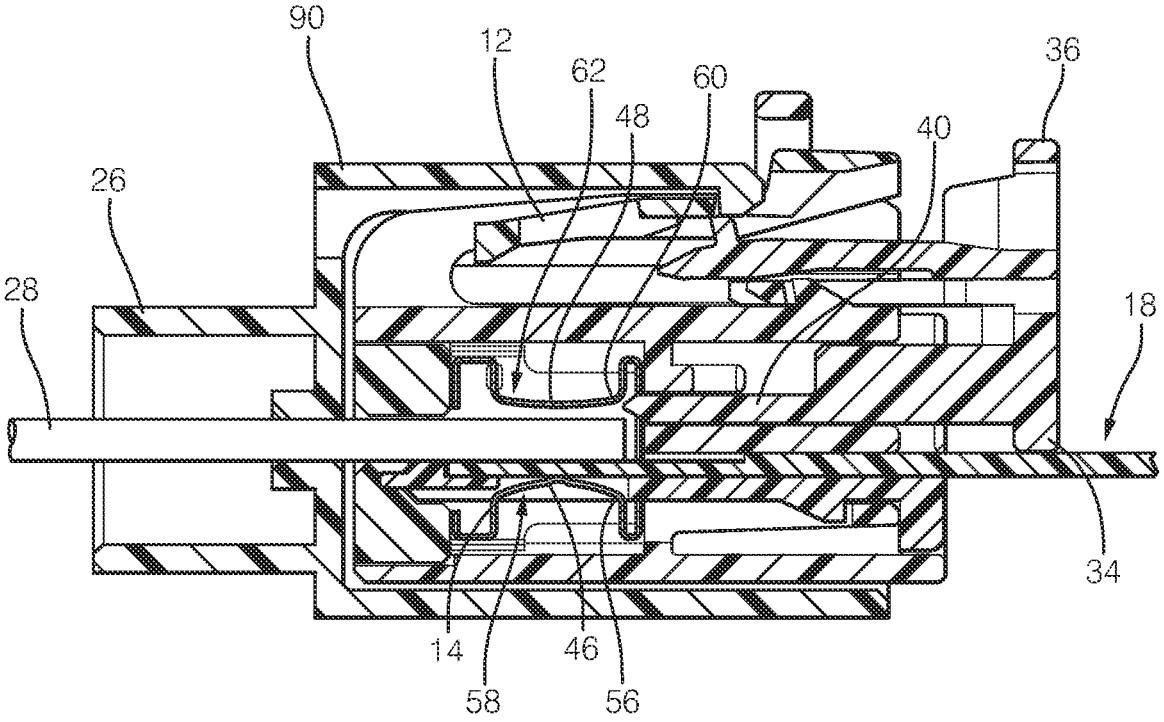
FIG. 16 is a cut away side view of the assembly of FIG. 13 interconnected with the printed circuit board of FIG. 15 having the connector position assurance device in the pre-staged position according to one embodiment of the invention.

The connector 10 and flat cable 18 are configured to be received within a corresponding mating connector 26 attached to a planar second substrate, in this particular non-limiting example a printed circuit board (PCB) 28, as best shown in FIGS. 15 and 16. The PCB 28 may be a component of an electronic controller (not shown) connected to the flat cable 18. The PCB 28 includes a plurality of electrically conductive second circuit traces 30, each having a second contact region 32. When the flat cable 18 and the PCB 28 are received within the connector 10, the housing 12 is configured to align the first contact regions 22 with the second contact regions 32. Once the connector 10 is mated with the mating connector 26, the spring array 14 is configured to apply a compressive contact force to the flat cable 18 and the PCB 28, thereby putting the first contact regions 22 in intimate compressive contact with the second contact regions 32.

Figure 17:
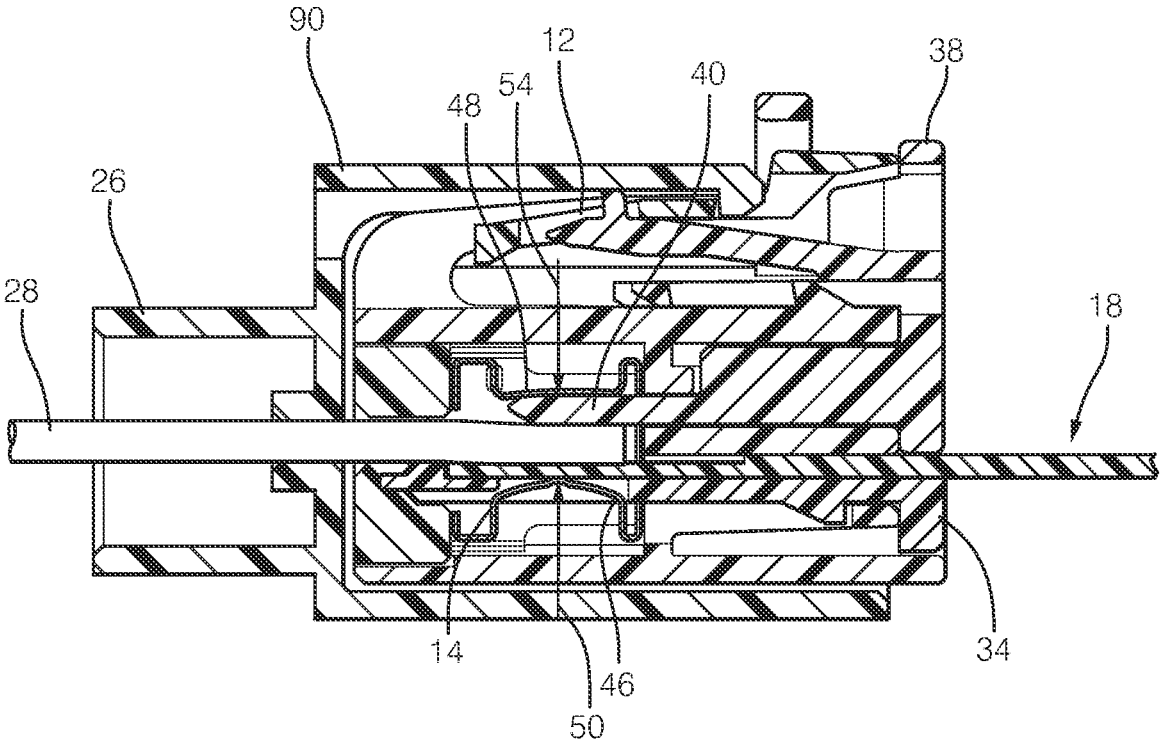
FIG. 17 is a cut away side view of the assembly of FIG. 13 interconnected with the printed circuit board of FIG. 15 having the connector position assurance device in the staged position according to one embodiment of the invention.

As best illustrated in FIGS. 12-17, the connector 10 also includes a connector position assurance (CPA) device 34 that is moveable from a pre-staged position 36 shown in FIG. 16 to a staged position 38 shown in FIG. 17. The CPA device 34 also includes an actuating member 40 that is configured to increase the compressive contact force applied to the flat cable 18 and the PCB 28 via interaction with the spring array 14.

Focusing now on the connector 10, the housing 12 and the retainer 16 are formed of a dielectric material, e.g. polyamide (PA, also known as nylon), polybutylene terephthalate (PBT), or another engineered polymer. As best shown in FIG. 2, the housing 12 defines a cavity 42 extending therethrough in which the spring array 14, the flat cable 18 and the PCB 28 are received. The spring array 14 is secured within the cavity 42 by latching features on the retainer 16 interfacing with corresponding features defined within the cavity 42.

Figure 11:
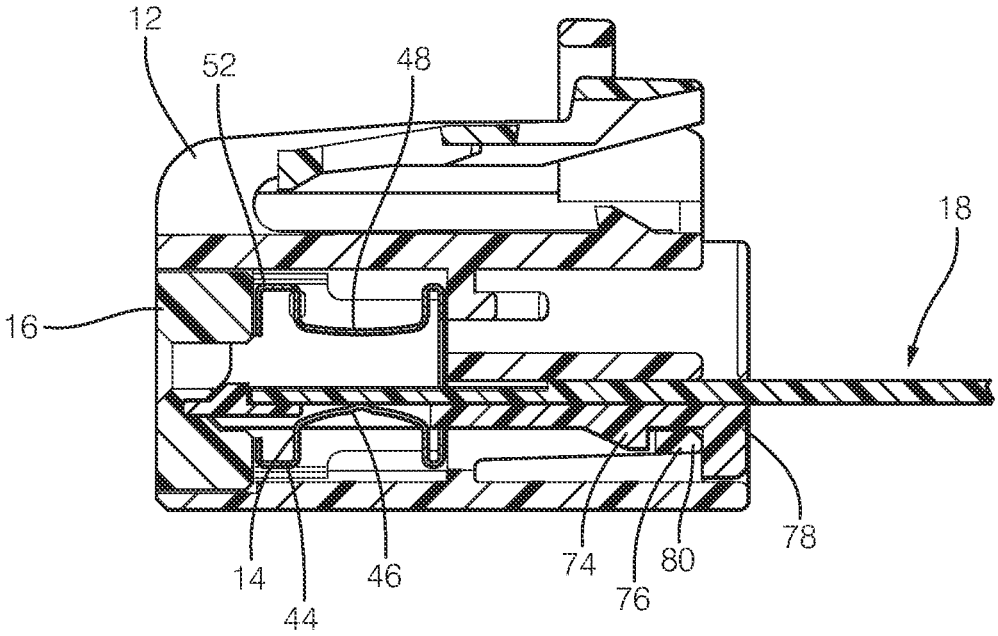
FIG. 11 is a side cross section view of the assembly of FIG. 9 according to one embodiment of the invention.

In the non-limiting example shown in FIG. 3, the spring array 14 has an open box shape that is formed by stamping and folding sheet metal, e.g. stainless steel, into the open box shape that surrounds the junction between the flat cable 18 and the PCB 28 when the connector 10 and the mating connector 26 are fully mated. As shown in FIG. 11, the bottom surface 44 of the spring array 14 defines a plurality of first spring members, hereinafter referred to as bottom spring members 46, that are integrally formed with the spring array 14 and are configured to apply a first component 50 of the compressive contact force to the flat cable 18. The top surface 52 opposite the bottom surface 44 defines a second spring member, hereinafter referred to as the top spring member 48, that is also integrally formed with the spring array 14 and is configured to apply a second component 54 of the compressive contact force to the PCB 28. The bottom spring members 46 are arranged such that they contact the flat cable 18 in locations opposite each of the first contact regions 22. This provides the benefit of providing the first component 50 of the compressive spring force to each of the first contact regions 22. The top spring member 48 may be a single spring member or may include a plurality of spring members.

As shown in FIG. 16, the bottom spring members 46 are in direct contact with the flat cable 18 while the top spring member 48 is not in contact with the PCB 28. Therefore, the second component 54 of the compressive contact force is applied to the PCB 28 by the actuating member 40 which is located intermediate the top spring member 48 and the PCB 28 and in mechanical contact with both the top spring member 48 and the PCB 28 when in the staged position 38 as shown in FIG. 17.

The open box shape of the spring array 14 is configured such that the compressive contact forces 50, 54 applied to the flat cable 18 and PCB 28 are supplied solely by the spring array 14. The spring array 14 is free floating within the housing 12 such that the housing 12 does not provide any of the compressive contact force to the flat cable 18 or the PCB 28. The inventors have found that the open sheet metal box of the spring array 14 diminishes a reduction in compressive contact forces 50, 54 that may occur over time or with exposure to elevated temperatures, e.g. temperatures exceeding 85° C. due to relaxation when a polymeric element, such as the housing 12, provides all or a portion of the compressive contact forces 50, 54.

As best shown in FIG. 16, the bottom spring members 46 each have an arcuate fixed beam portion 56 with a first radius of curvature 58 and the top spring member 48 each have an arcuate fixed beam portion 60 having a second radius of curvature 62. As can be seen in FIG. 16, the first radius of curvature 58 of the bottom spring members 46 is less than the second radius of curvature 62 of the top spring member 48. This difference in the radii of curvature 58, 62 provides two separate benefits. The shorter radius of the first curvature 58 of the bottom spring members 46 forms an apex that causes a smaller contact patch between each bottom spring member 46 and the flat cable 18, thereby increasing a contact pressure applied between the first contact region and the second contact region 32. The longer second radius of curvature 62 of the top spring member 48 provides a smaller deviation between an initial insertion force and a peak insertion force as the actuating member 40 is moved from the pre-staged position 36 to the staged position 38 and is inserted between the top spring member 48 and the PCB 28. The spring array 14 is not an electrical current carrying member of the connector 10. Therefore, the material choice for the material used to form the spring array 14 may be based on the mechanical properties of the material without any regard to the electrical properties.

Alternative embodiments of the connector may not include an actuating member and in these embodiments the top spring member may be in direct contact with the PCB. In these embodiments it may be preferred to have an electrically insulative surface of the PCB in contact with the top spring member or to have an electrical insulative member between the top spring member and the PCB to avoid electrical short circuiting of conductive traces on the PCB. Additionally, alternative embodiments of the connector may include top and bottom spring members that are cantilevered springs, coil springs, elliptical springs, or other types of compression springs. In applications where polymeric creep or relaxation are not a design factor, the spring array may be formed of a polymeric material since the spring array is not a current carrying member and or may not be a separate open box design but may be integrated into the housing.

Figure 12:
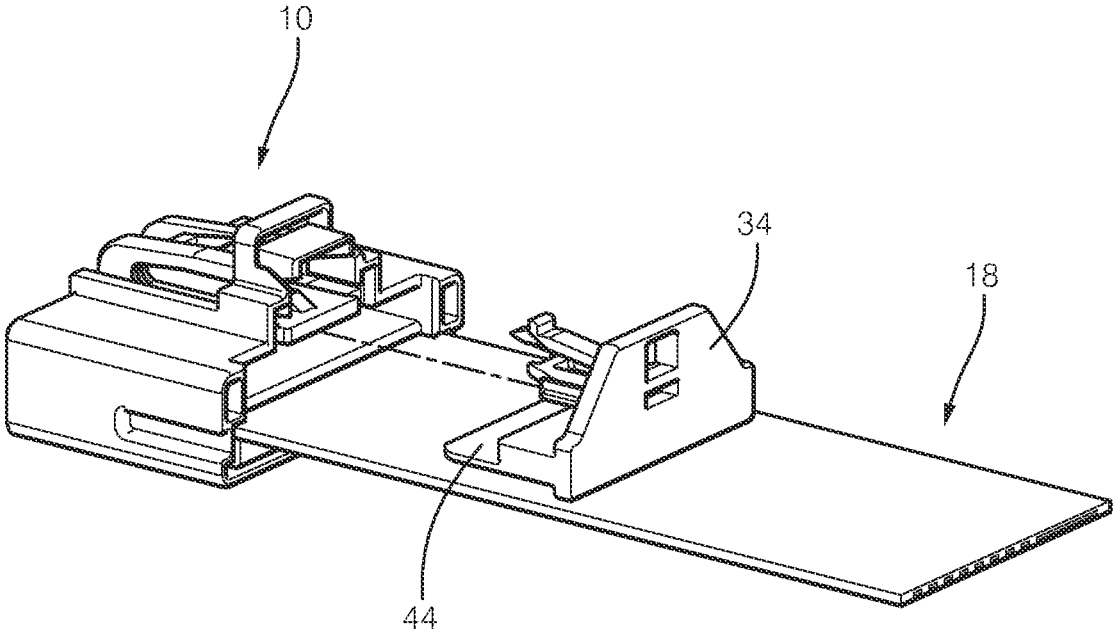
FIG. 12 is a perspective exploded view of a connector position assurance device including an actuating member prior to insertion in the assembly of FIG. 9 according to one embodiment of the invention.

A best shown in FIG. 12, the actuating member 40 is a planar member that is integral with the CPA device 34. The CPA device 34 is formed of a dielectric material, such as PA or PBT. The CPA device 34 is slidably attached to the housing 12 and is configured to ensure that the connector 10 is fully mated with the mating connector 26. The CPA device 34 is designed such that it may not be moved from the pre-staged position 36 to the staged position 38 until the connector 10 is fully mated with the mating connector 26. The design and operation of CPA devices for electrical connectors are well known to those having ordinary skill in the art. The thickness of the actuating member 40 is sized such that the second component 54 of the compressive contact force is within a predetermined range regardless of an overall thickness of the flat cable 18 and the PCB 28. In alternative embodiments, the actuating member may include a plurality of individual fingers aligned with the second contact regions rather than a single planar member.

Figure 5:
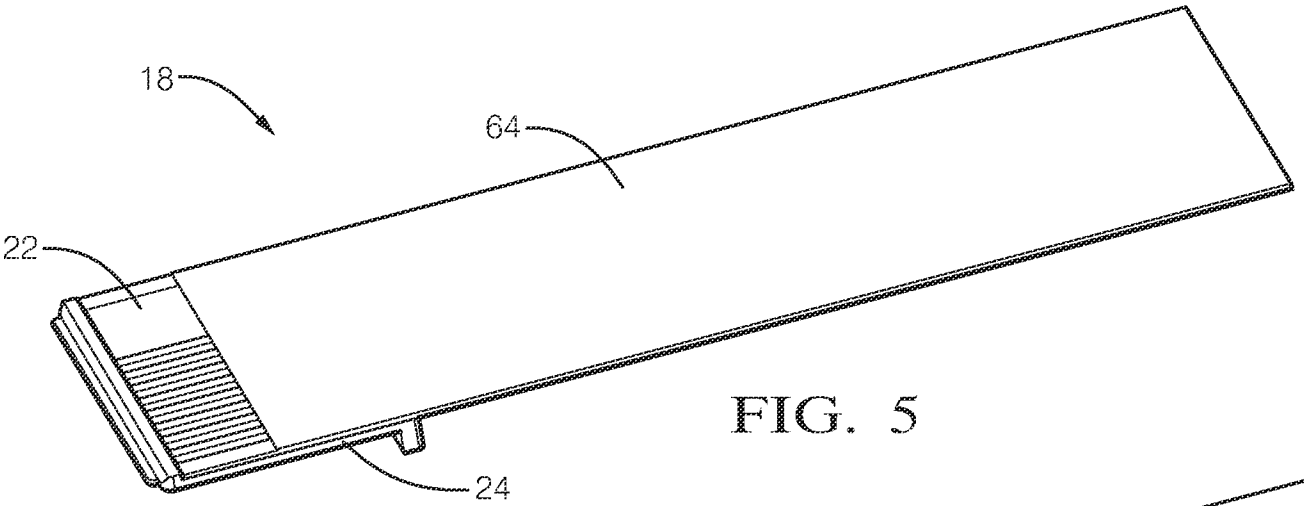
FIG. 5 is a perspective view of a flat cable used with the electrical connector assembly of FIG. 1 according to one embodiment of the invention.
Figure 6:
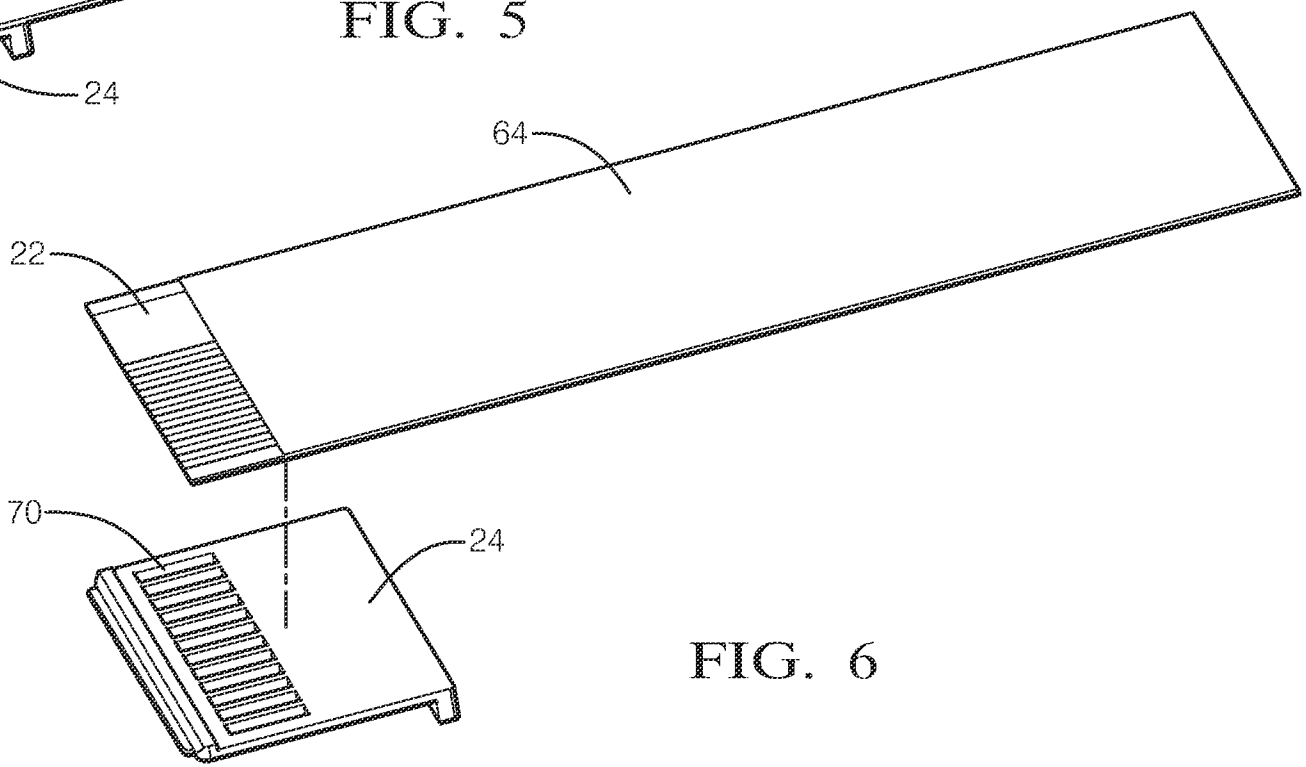
FIG. 6 is an exploded perspective view of the flat cable used of FIG. 5 according to one embodiment of the invention.
Figure 7A:
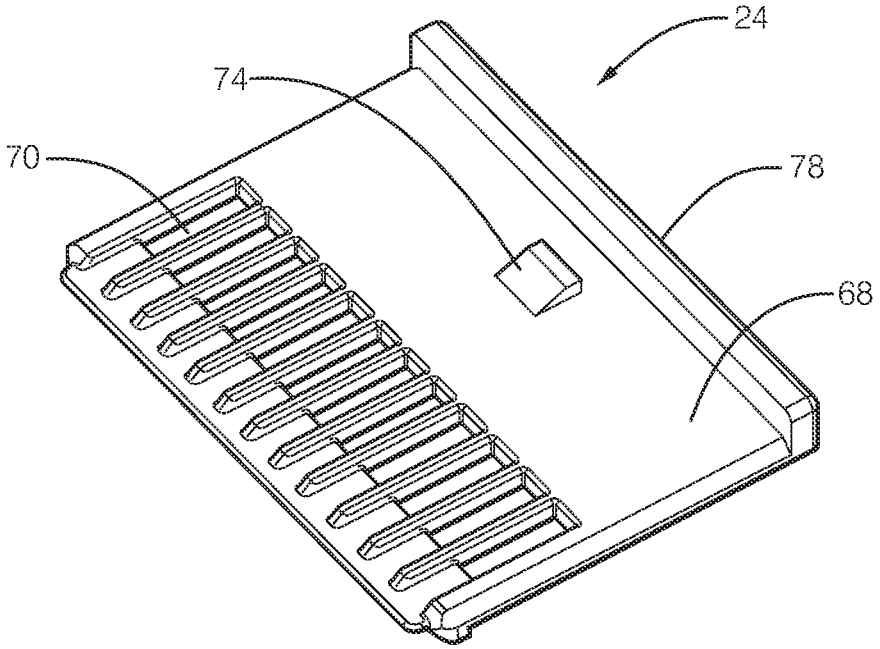
FIG. 7A is a perspective top view of stiffening member of the flat cable of FIG. 5 according to one embodiment of the invention.
Figure 7B:
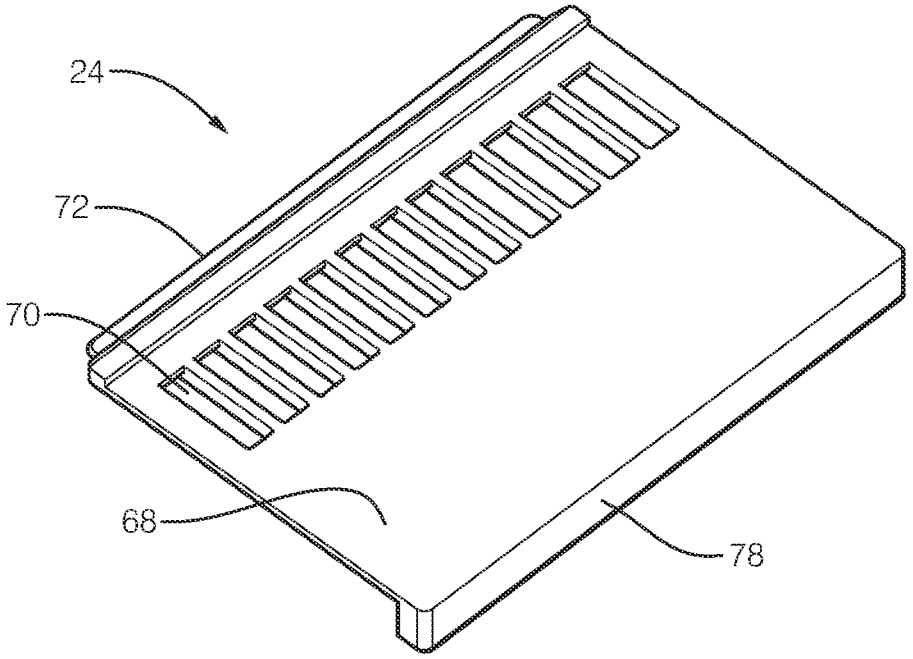
FIG. 7B is a perspective bottom view of stiffening member of the flat cable of FIG. 5 according to one embodiment of the invention.

Focusing now on the flat cable 18 as illustrated in FIG. 5, the flat cable 18 includes a flexible substrate 64 including the flat first conductive traces, e.g. thin copper strips, encased within an insulative material, such as polyethylene terephthalate (PET). Such a flat cable 18 is typically referred to as a flexible flat cable 18 (FFC) or flexible printed circuit (FPC). As shown in FIG. 5, the width of the first conductive traces may be varied to provide different electrical characteristics, e.g. resistance or current capacity. The insulative material is removed from at least one end of the flat cable 18 to expose the first conductive traces, thereby providing the first contact regions 22.

The flat cable 18 also includes a stiffening member 24 that is attached to an end of the flat cable 18 on a side of the flat cable 18 located opposite the first contact regions 22. The stiffening member 24 may be attached to the flat cable 18 using a pressure bond adhesive (not shown), such as VHB™ double sided adhesive tape manufactured by the 3M Corporation of Minneapolis, Minn. The stiffening member 24 is formed of a dielectric material, such as PA or PBT and includes a planar body portion 68 and a plurality of openings 70 extending through the body portion and configured to allow contact on the surface of the flat cable 18 opposite the first contact regions 22 by the bottom spring members 46.

Figure 13:
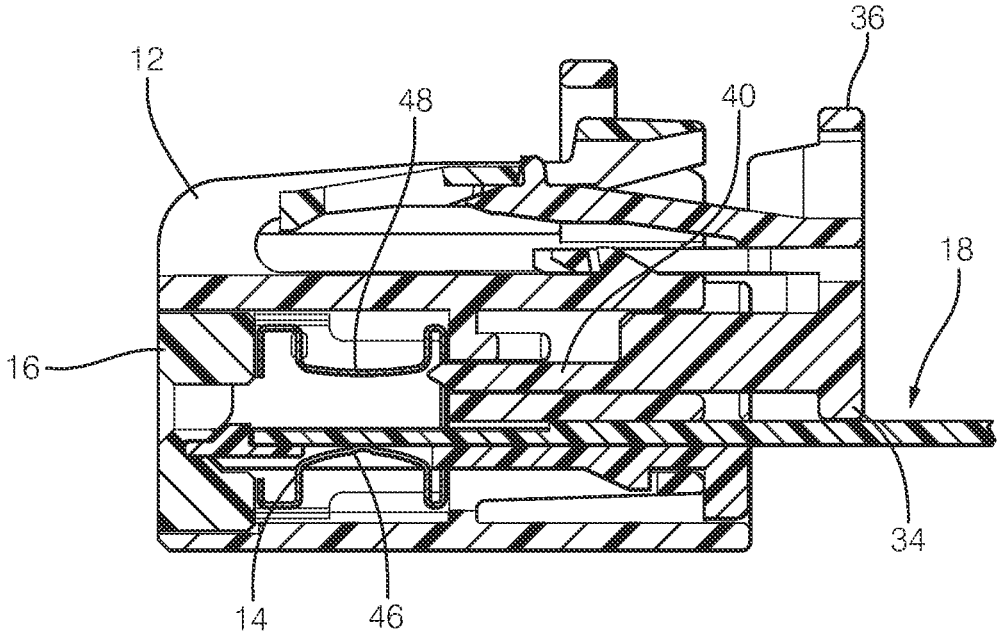
FIG. 13 is a side cross section view of the assembly of FIG. 9 with the connector position assurance device assembled to the electrical connector of FIG. 1 and in a pre-staged position according to one embodiment of the invention.
Figure 14:
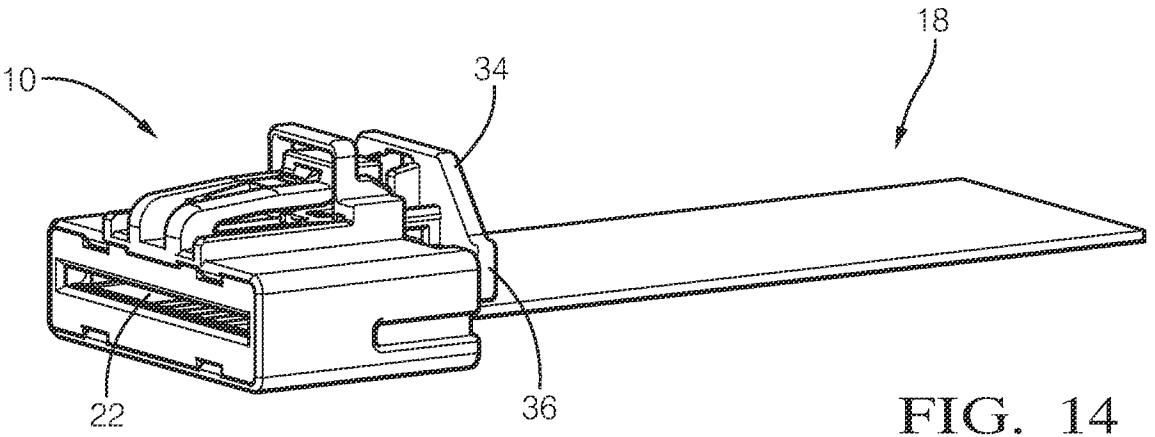
FIG. 14 is a perspective view of the assembly of FIG. 13 according to one embodiment of the invention.

The stiffening member 24 includes an angled lip 72 on a forward edge of the stiffening member 24 that has a maximum height that is at least equal to a thickness of the flat cable 18. This angled lip 72 is configured to protect the flat cable 18 as the flat cable 18 and stiffening member 24 are inserted within the cavity 42 and spring array 14. The stiffening member 24 additionally includes a locking latch 74 configured to engage a strike surface 76 within the cavity 42 of the housing 12. Without subscribing to any particular theory of operation, as the stiffening member 24 is inserted within the cavity 42, the angled forward edge of the locking latch 74 causes the planar body to bend upwardly until the rearward edge of the locking latch 74 clears the strike surface 76 and planar body returns to its planar form, thereby engaging the rearward edge of the locking latch 74 with the strike surface 76. The locking latch 74 and strike surface 76 cooperate to retain the stiffening member 24 within the housing 12. A rearward edge stiffening member 24 of the stiffening member 24 defines a ridge 78 that is configured to contact a rearward surface 80 of the housing 12 of the electrical connector 10, thereby positioning the stiffening member 24 within the housing 12. As best shown in FIG. 13, the locking latch 74, the ridge 78, and the retainer 16 cooperate to position the first contact regions 22 within the connector 10.

Figure 18:
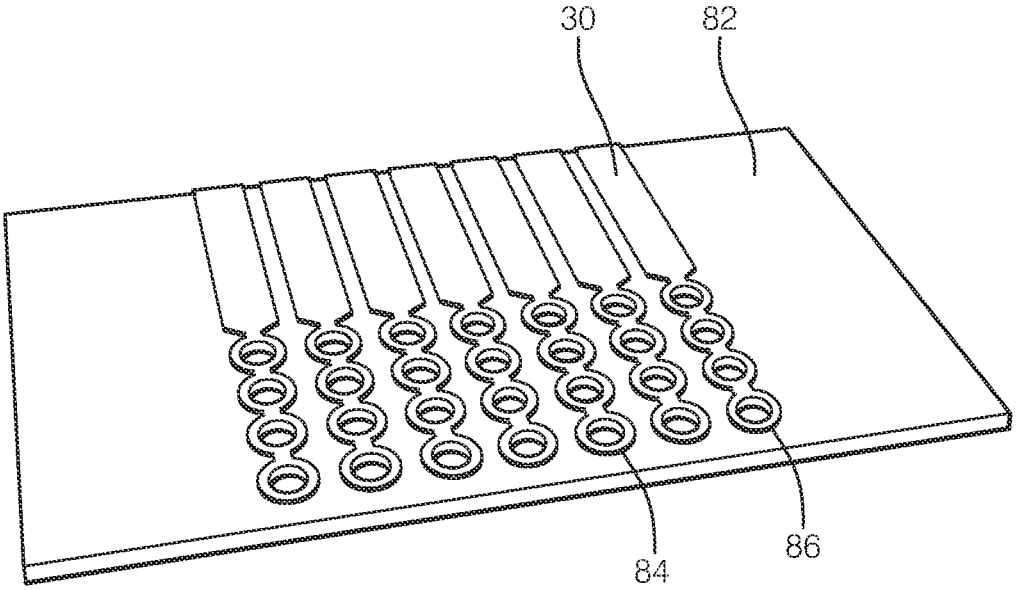
FIG. 18 is an isolated view of a contact region of the printed circuit board of FIG. 15 according to one embodiment of the invention.
Figure 19:
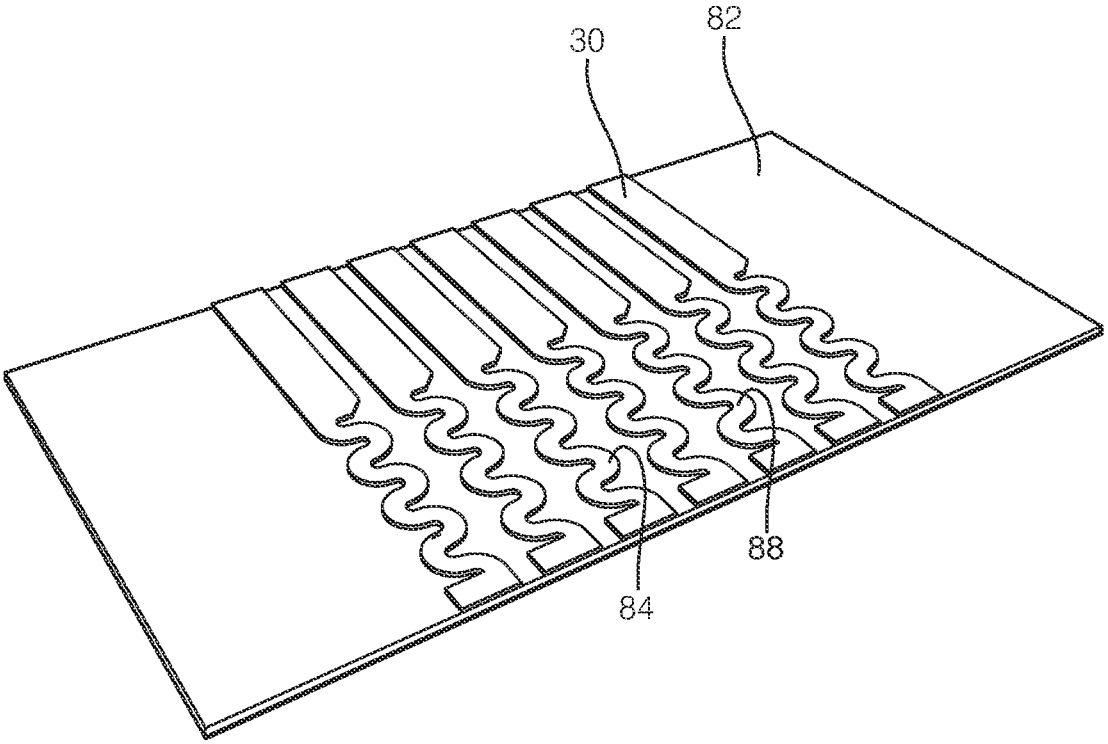
FIG. 19 is an isolated view of a contact region of the printed circuit board of FIG. 15 according to another embodiment of the invention.

Focusing now on the PCB 28 as shown in FIGS. 18 and 19, the PCB 28 includes a circuit board substrate 82 and the plurality of second conductive traces 30 disposed thereon. Exposed ends of the second conductive traces 30 define the second contact regions 32. The second contact regions 32 define a plurality of ridges 84 protruding from a circuit board substrate surface that are configured to concentrate stress on the first contact regions 22. Without subscribing to any particular theory of operation, these stress concentrations increase reliability and current carrying capacity of the connection between the first contact regions 22 and the second contact regions 32.

The PCB 28 may use a circuit board substrate 82 that is formed of epoxy or polyimide resins. The resin may be reinforced with a woven glass cloth or other matrix such as chopped fibers. Substrates formed of such materials are typically referred to as FR-4or G-10 type circuit boards. The PCB 28 may alternatively be constructed of ceramic or rigid polymer materials. This listing of acceptable substrate materials is not exhaustive and other materials may also be used successfully. A layer of conductive material, such as a copper-based material is electroplated on at least one major surface of the PCB 28. The layer of conductive material is then formed to create the second conductive traces 30 and second contact regions 32 typically by using a chemical etching process.

In some embodiments of the invention, the plurality of ridges 84 is formed on outer edges of a plurality of plated through holes or vias 86 in the second contact region 32 as shown in FIG. 18. Each of the second contact regions 32 may include several interconnected vias 86 arranged linearly.

Each via 86 consists of two pads in corresponding positions on different layers of the substrate 82 that are electrically connected by a hole through the board. The hole is made conductive by electroplating. The electroplating is thickest on the outside edge of the pad and is tapered in thickness as it approaches the hole, thereby forming or an "inverted volcano", i.e. frustoconical, shape. The pad on one or both sides of the PCB 28 is connected to the second conductive traces 30 on the surface of the PCB 28. The second conductive traces 30 interconnect each of the second contact regions 32 to electrical components on the PCB 28. The materials and manufacturing techniques used to the form PCBs and vias are well known to those skilled in the art.

In other embodiments of the invention, the plurality of ridges 84 is formed by a serpentine pattern 88 in the second conductive traces 30 within the second contact region 32 as shown in FIG. 19.

The printed circuit board also includes the mating connector 26 which defines a shroud 90 surrounding the second contact region 32 that is configured to receive a forward portion of the housing 12 of the connector 10. The connector 10 and the mating connector 26 cooperate to align the first contact regions 22 with the second contact regions 32.

While the examples of the connector 10 described herein is configured to connect a flat cable 18 with a PCB 28, other embodiments of the connector may be envisioned in which the connector is configured to interconnect one flat cable with another flat cable to make an in-line connection.

Additionally, while the connector 10 described herein is configured to connect a single flat cable 18 with a PCB 28, other embodiments of the connector may be envisioned in which the connector is configured to interconnect two flat cables with the PCB; one flat cable connected to each side of the PCB.

Further, while the connector 10 described herein includes an actuating member 40 that is integrated with a CPA device 34. Other embodiments of the invention may be envisioned in which the actuating member is implemented without a CPA device.

Accordingly, an electrical connector 10 is presented. The connector provides a zero insertion force (ZIF) connection between the flat cable 18 and the PCB 28, another flat cable, or any other flat substrate having suitably aligned contact regions while providing a high contact force after the actuating member 40 moved to the staged position 38. The connector 10 also provides reduced wiping forces between the first and second contact regions 22, 32 as the connector 10 and the mating connector 26 are attached to one another. The thickness of the actuating member 40 may be adjusted to accommodate different thicknesses of the flat cable(s), PCB, or other substrate without having to make changes to the housing 12, retainer 16, or the spring array 14 of the connector 10. The actuating member 40 and the spring array 14 cooperate to beneficially provide a uniform compressive contact pressure on each pair of first and second contact regions 22, 32. Additionally, the ridges 84 formed in the second contact regions 32 create stress concentrations that increase the reliability and current carrying capacity of the connection between the first contact regions 22 and the second contact regions 32.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising:

a housing including a planar first substrate having an electrically conductive first contact region and configured to receive a planar second substrate having an electrically conductive second contact region which defines a ridge protruding from a surface of the second substrate, wherein the housing is configured to align the first contact region with the second contact region; and a force application device configured to apply a compressive contact force to the first and second substrates, thereby putting the first contact region in intimate compressive contact with the second contact region, the force application device comprising:

an arcuate first fixed beam having a first radius of curvature configured to apply a first compressive contact force to the first substrate, and an arcuate second fixed beam having a second radius of curvature configured to apply a second compressive contact force to the second substrate, wherein the first radius of curvature is less than the second radius of curvature.

2. The electrical connector assembly according to claim 1, wherein the ridge is formed on an outer edge of a plated through hole in the second contact region and wherein a height of the ridge decreases from the outer edge to the plated through hole.

3. The electrical connector assembly according to claim 2, wherein the ridge forms an inverted frustoconical shape.

4. The electrical connector assembly according to claim 2, wherein the second contact region defines a plurality of the plated through holes arranged linearly in the second contact region.

5. The electrical connector assembly according to claim 1, wherein the ridge is formed by a serpentine pattern in the second contact region.

6. The electrical connector assembly according to claim 1, wherein the arcuate first fixed beam and the arcuate second fixed beam are integrally formed within the force application device.

7. The electrical connector assembly according to claim 6, further comprising:

an actuating member that is moveable from a pre-staged position in which the actuating member is not located intermediate the arcuate first fixed beam and the arcuate second fixed beam to a staged position in which the actuating member is located intermediate the arcuate first fixed beam and the arcuate second fixed beam.

8. The electrical connector according to claim 7, wherein the actuating member is integral with a connector position assurance device that is configured to allow movement of the actuating member from the pre-staged position to the staged position when the housing is received within and fully mated with a corresponding mating connector.

9. The electrical connector according to claim 7, wherein the actuating member is sized, shaped, and arranged such that an increase in the compressive contact force is within a predetermined range regardless of an overall thickness of the first substrate and the second substrate.

10. The electrical connector according to claim 1, wherein the force application device has an open box-like structure that is configured to surround the first substrate and the second substrate.

11. The electrical connector according to claim 1, wherein the force application device is formed of a metallic material and the housing is formed of a polymeric material.

12. The electrical connector according to claim 1, wherein the first contact region is defined by an electrically conductive first trace on the first substrate and the second contact region is defined by an electrically conductive second trace on the second substrate and wherein the second substrate is a printed circuit board.

13. The electrical connector according to claim 1, wherein the second contact region defines a plurality of ridges protruding from a surface of the second substrate.

14. An electrical connector system, comprising:

a housing; a planar first substrate disposed within the housing and having a first contact region;

a shroud configured to receive the housing within, wherein the shroud includes a planar second substrate having a second contact region defining a ridge protruding from a surface of the second substrate, wherein the housing and the shroud are configured to align the first contact region with the second contact region; and a force application device configured to apply a compressive contact force to the first and second substrates, thereby putting the first contact region in intimate compressive contact with the second contact region, the force application device comprising:

a first spring member configured to apply a first compressive contact force to the first substrate, and a second spring member configured to apply a second compressive contact force to the second substrate, wherein the housing further comprises an actuating member that is moveable from a pre-staged position in which the actuating member is not located intermediate the first spring member and the second spring member to a staged position in which the actuating member is located intermediate the first spring member and the second spring member.

15. The electrical connector system according to claim 14, wherein the actuating member is integral with a connector position assurance device that is configured to allow movement of the actuating member from the pre-staged position to the staged position when the housing is received within and fully mated with a corresponding mating connector.

16. An electrical connector assembly, comprising:

a housing including a planar first substrate having an electrically conductive first contact region and configured to receive a planar second substrate having an electrically conductive second contact region which defines a ridge protruding from a surface of the second substrate, wherein the housing is configured to align the first contact region with the second contact region; and a force application device configured to apply a compressive contact force to the first and second substrates, thereby putting the first contact region in intimate compressive contact with the second contact region, the force application device comprising:

a first spring member configured to apply a first compressive contact force to the first substrate, and a second spring member configured to apply a second compressive contact force to the second substrate, wherein the housing further includes an actuating member that is moveable from a pre-staged position in which the actuating member is not located intermediate the first spring member and the second spring member to a staged position in which the actuating member is located intermediate the first spring member and the second spring member.

17. The electrical connector assembly according to claim 16, wherein the ridge is formed on an outer edge of a plated through hole in the second contact region wherein a height of the ridge decreases from the outer edge to the plated through hole.

18. The electrical connector assembly according to claim 16, wherein the ridge is formed by a serpentine pattern in the second contact region.

19. The electrical connector assembly according to claim 16, wherein the first spring member and the second spring member are integrally formed within the force application device.

20. The electrical connector assembly according to claim 16, wherein the actuating member is integral with a connector position assurance device that is configured to allow movement of the actuating member from the pre-staged position to the staged position when the housing is received within and fully mated with a corresponding mating connector.

* * * * *